US007755594B2

(12) United States Patent
Yoshihara et al.

(10) Patent No.: US 7,755,594 B2
(45) Date of Patent: Jul. 13, 2010

(54) DISPLAY DEVICE AND DISPLAY METHOD

(75) Inventors: Toshiaki Yoshihara, Kawasaki (JP); Tetsuya Makino, Kawasaki (JP); Keiichi Betsui, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 516 days.

(21) Appl. No.: 10/743,806

(22) Filed: Dec. 24, 2003

(65) Prior Publication Data

US 2004/0246275 A1 Dec. 9, 2004

(30) Foreign Application Priority Data

Jan. 29, 2003 (JP) ..... 2003-020768

(51) Int. Cl.
*G09G 3/36* (2006.01)

(52) U.S. Cl. ..... 345/102; 345/87; 345/100; 345/690

(58) Field of Classification Search ..... 345/87–102, 345/204, 690, 694, 212, 214, 211, 85; 348/70, 348/269, 273; 349/25, 30, 97, 106
See application file for complete search history.

(56) References Cited

U.S. PATENT DOCUMENTS 5,589,852 A * 12/1996 Thompson et al. ..... 345/690
6,448,951 B1 * 9/2002 Sakaguchi et al. ..... 345/88
6,683,657 B1 1/2004 Miyawaki
6,961,038 B2 * 11/2005 Yoshinaga et al. ..... 345/88
7,030,848 B2 * 4/2006 Sato et al. ..... 345/95
7,053,880 B2 * 5/2006 Lim et al. ..... 345/102
7,365,729 B2 * 4/2008 Hong ..... 345/102
2001/0052891 A1 12/2001 Yoshihara et al.
2002/0057238 A1 5/2002 Nitta et al.
2002/0135553 A1 9/2002 Nagai et al.
2002/0149549 A1 10/2002 Ohta et al.

(Continued)

FOREIGN PATENT DOCUMENTS

JP 11-119189 4/1999

(Continued)

OTHER PUBLICATIONS

Korean Office Action dated Apr. 10, 2009 issued in corresponding Korean paten Application No. 10-2003-0094507.

(Continued)

*Primary Examiner*—Duc Q Dinh
(74) *Attorney, Agent, or Firm*—Westerman, Hattori, Daniels & Adrian, LLP

(57) ABSTRACT

The grayscale levels of red, green and blue display data are detected in each sub-frame, and the intensity of incident light on a liquid crystal panel and the transmittance of the liquid crystal panel are adjusted based on the detection result. The transmittance of the liquid crystal panel is adjusted to have maximum transmittance for display data that requires a maximum amount of transmitted light in each of red, green and blue sub-frames, and the intensity of incident light is reduced according to the adjustment result of the transmittance. By reducing the amount of incident light on the display element to the minimum required amount, the power consumed by a back-light is reduced as much as possible while maintaining the display images of the respective colors according to the grayscale levels.

11 Claims, 16 Drawing Sheets

U.S. PATENT DOCUMENTS

| | | | |
|---|---|---|---|
| 2003/0164685 | A1 | 9/2003 | Inukai |
| 2004/0041752 | A1 | 3/2004 | Kimura |
| 2006/0279523 | A1 | 12/2006 | Nitta et al. |

FOREIGN PATENT DOCUMENTS

| | | | |
|---|---|---|---|
| JP | 2000147454 | A | 5/2000 |
| JP | 2000-214827 | A | 8/2000 |
| JP | 2000275605 | A | 10/2000 |
| JP | 2000347632 | A | 12/2000 |
| JP | 2001100699 | A | 4/2001 |
| JP | 2002099250 | A | 4/2002 |
| JP | 2002156950 | A | 5/2002 |
| JP | 2002-318564 | A | 10/2002 |
| WO | 0169584 | A1 | 9/2001 |

OTHER PUBLICATIONS

Japanese Office Action dated Jul. 7, 2009 issued in corresponding Japanese patent Application No. 2003-020768 (w/Partial English Translation).

Yoshihara et al., "A Full-color FLC Display Based on Field Sequential Color with TFTs" Japan society of Applied Physics Digest of Technical Papers, Jul. 14-16, 1999; p. 185-188.

Yoshihara et al., "Inveneted Paper: A254-ppi Full-color Video Rate TFT-LCD Based on Field Sequential Color and FLC Display" Society for Information Display Digest of Technical Papers: May 2000; p. 1176-1177.

* cited by examiner (a) SCANNING OF LIQUID CRYSTAL PANEL (b) ON TIMING OF BACK-LIGHT

DISPLAY DEVICE AND DISPLAY METHOD

BACKGROUND OF THE INVENTION

The present invention relates to a field-sequential type display device and display method for performing a display by synchronizing the switching of colors of light incident on a display element with the light control in the display element based on display data of respective colors, and also relates to a color-filter type display device and display method for performing a color display by synchronizing the incidence of white light on a display element having color filters with the light control in the display element based on display data of respective colors.

Along with the recent development of so-called information-oriented society, electronic apparatuses, such as personal computers and PDA (Personal Digital Assistants), have been widely used. With the spread of such electronic apparatuses, portable apparatuses that can be used in offices as well as outdoors have been used, and there are demands for small-size and light-weight of these apparatuses. Liquid crystal display devices are widely used as one of the means to satisfy such demands. Liquid crystal display devices not only achieve small size and light weight, but also include an indispensable technique in an attempt to achieve low power consumption in portable electronic apparatuses that are driven by batteries.

The liquid crystal display devices are mainly classified into the reflection type and the transmission type. In the reflection type liquid crystal display devices, light rays incident from the front face of a liquid crystal panel are reflected by the rear face of the liquid crystal panel, and an image is visualized by the reflected light; whereas in the transmission type liquid crystal display devices, the image is visualized by the transmitted light from a light source (back-light) placed on the rear face of the liquid crystal panel. Since the reflection type liquid crystal display devices have poor visibility because the reflected light amount varies depending on environmental conditions, transmission type color liquid crystal display devices using color filters are generally used as the display devices of personal computers displaying full-color images.

As the color liquid crystal display devices, TN (Twisted Nematic) type liquid crystal display devices using switching elements such as a TFT (Thin Film Transistor) are widely used at present. Although the TFT-driven TN type liquid crystal display devices have better display quality compared to an STN (Super Twisted Nematic) type, they require a back-light with high intensity to achieve high screen brightness because the light transmittance of the liquid crystal panel is only 4% or so at present. For this reason, a lot of power is consumed by the back-light. Besides, since a color display is achieved using color filters, a single pixel needs to be composed of three sub-pixels, and there are problems that it is difficult to provide a high-resolution display, and the purity of the displayed colors is not sufficient.

In order to solve such problems, the present inventor et al. developed field-sequential type liquid crystal display devices (see, for example, T. Yoshihara et al., AM-LCD '99 Digest of Technical Papers, p. 185, 1999; and T. Yoshihara et al., SID '00 Digest of Technical Papers, p. 1176, 2000). Since such a field-sequential type liquid crystal display device does not require sub-pixels, it is possible to easily achieve a higher resolution display compared to a color-filter type liquid crystal display device. Moreover, since the field-sequential type liquid crystal display device can use the color of light emitted by the light source as it is for display without using a color filter, the displayed color has excellent purity. Furthermore, since the light utilization efficiency is high, this device has the advantage of low power consumption. However, in order to realize a field-sequential type liquid crystal display device, a high-speed responsiveness (2 ms or less) of liquid crystal is essential.

In order to provide a field-sequential type liquid crystal display device with significant advantages as mentioned above or increase the speed of response of a color-filter type liquid crystal display device, the present inventor et al. are conducting research and development on the driving of liquid crystal such as a ferroelectric liquid crystal having spontaneous polarization, which may achieve 100 to 1000 times faster response compared to a conventional type, with a switching element such as a TFT. In the ferroelectric liquid crystal, as shown in FIG. 1, the long-axis direction of the liquid crystal molecule is tilted by the application of voltage. A liquid crystal panel sandwiching the ferroelectric liquid crystal therein is sandwiched by two polarization plates whose polarization axes are orthogonal to each other, and the intensity of transmitted light is changed using the birefringence caused by a change in the long-axis direction of the liquid crystal molecule.

FIG. 2 illustrate an example of time chart of display control in a conventional field-sequential type liquid crystal display device, wherein FIG. 2(*a*) shows the scanning timing of each line of the liquid crystal panel, and FIG. 2(*b*) shows the ON timing of red, green and blue colors of the back-light. One frame is divided into three sub-frames, and, for example, as shown in FIG. 2(*b*), red light is emitted in the first sub-frame, green light is emitted in the second sub-frame, and blue light is emitted in the third sub-frame.

Meanwhile, as shown in FIG. 2(*a*), for the liquid crystal panel, image data writing scanning and erasing scanning are performed within a sub-frame of each of red, green and blue colors. However, the timings are adjusted so that the start timing of the writing scanning coincides with the start timing of each sub-frame, and the end timing of the erasing scanning coincides with the end timing of each sub-frame, and the time necessary for each of the writing scanning and the erasing scanning is set to a half of each sub-frame. During the writing scanning and the erasing scanning, voltages which are equal in magnitude and different in polarity based on the same image data are applied to the liquid crystal panel. Moreover, the light emission time of each color is equal to the time of a sub-frame (see, for example, Japanese Patent Application Laid-Open No. 11-119189/1999).

Field-sequential type liquid crystal display devices have the advantages of high light utilization efficiency and reducing power consumption. However, in order to mount a field-sequential type liquid crystal display device on a portable apparatus, a further reduction in power consumption is required. Such a requirement for reduction in power consumption is directed not only to a field-sequential type liquid crystal display device using a liquid crystal element as a display element, but also to field-sequential type display devices using other display elements such as a digital micro mirror device (DMD) and also to color-filter type display devices similarly.

BRIEF SUMMARY OF THE INVENTION

The present invention has been made with the aim of solving the above problems, and it is an object of the present invention to provide a display device and display method capable of reducing power consumption without causing deterioration in the displayed image quality, particularly a decrease in brightness.

A field-sequential type display device according to a first aspect comprises: detecting means for detecting a grayscale level of display data; and adjusting means for adjusting an intensity of light incident on a display element and a light control variable in the display element, based on a detection result of the detecting means. A field-sequential type display method according to a fourteenth aspect detects a grayscale level of display data, and adjusts an intensity of light incident on a display element and a light control variable in the display element, based on a detection result of the grayscale level.

In the first and fourteenth aspects, when performing display by a field-sequential method by successively causing lights of a plurality of colors to be incident on the display element from a light source and synchronizing the switching of light to be incident on the display element with the light control (switching) in the display element based on display data of each color corresponding to an image to be displayed, the grayscale level of display data corresponding to a color of light incident on the display element is detected, and the intensity of light incident on the display element and the light control variable (switching variable) in the display element are adjusted based on the detection result.

It is thus possible to adjust the intensity of incident light and the light control variable according to display data. For display data that does not require the brightest display, by reducing the intensity of light incident on the display element and adjusting the light control variable to increase the transmittance or reflectance of incident light on the display element, it is possible reduce the power consumed by the light source while maintaining a screen brightness equivalent to that obtained without adjusting the intensity of incident light and the light control variable.

The concept of such an invention will be explained in comparison to a conventional example. FIG. 3 and FIG. 4 are views for explaining the concept of a field-sequential type display device of the conventional example and that of the present invention, respectively. In the conventional example shown in FIG. 3, the amount of incident light on the display element is constant in each color, and the transmittance or reflectance by the light control in the display element is a value according to a grayscale level of display data. Displayed images of the respective colors according to the grayscale levels of display data are obtained by only adjusting the transmittance or reflectance.

On the other hand, in the present invention shown in FIG. 4, the amount of incident light on the display element and the transmittance or reflectance by the light control in the display element are adjusted according to a grayscale level of display data, so that the amount of incident light on the display element is smaller and the transmittance or reflectance is larger compared to the case where the adjustments are not performed (FIG. 3). It is thus possible to achieve a reduction in power consumption while maintaining the displayed images of the respective colors according to the grayscale levels.

A display device according to a second aspect is the device of the first aspect, wherein the detection of a grayscale level by the detecting means and the adjustments of the intensity of incident light and the light control variable by the adjusting means are performed for each color of light incident on the display element. In the second aspect, the detection of a grayscale level and the adjustments of the intensity of incident light and the light control variable are performed for each color of light incident on the display element (namely, in each sub-frame). Thus, since the intensity of incident light and the light control variable can be adjusted for each color, it is possible to make finer adjustments.

A display device according to the third aspect is the device of the first or second aspect, wherein the detecting means detects a grayscale level of maximum brightness of the display data in a predetermined period, and, when obtaining the maximum brightness, the adjusting means adjusts the light control variable in the display element so as to have maximum transmittance or reflectance of incident light on the display element and adjusts the intensity of incident light according to the adjusted light control variable. In the third aspect, a grayscale level of maximum brightness is detected, and, in order to achieve a brightness corresponding to the grayscale level, the light control variable in the display element is adjusted so as to have maximum transmittance or reflectance of incident light on the display element, and the intensity of incident light is adjusted according to the adjusted light control variable. Therefore, since the light control variable in the display element is adjusted so as to have maximum transmittance or reflectance of incident light on the display element for the grayscale level of maximum brightness in each sub-frame, it is possible to decrease the amount of incident light on the display element to the minimum required amount and reduce the power consumed by the power source as much as possible.

A display device according to a fourth aspect is the device of the third aspect, wherein, when obtaining brightness of a grayscale level other than the grayscale level of maximum brightness, the adjusting means adjusts the light control variable in the display element. In the fourth aspect, the light control variable in the display element is adjusted so as to obtain a desired brightness even for a grayscale level other than the grayscale level of maximum brightness. Consequently, even when the intensity of incident light is decreased, it is possible to achieve a clear display equivalent to that obtained without adjusting the intensity of incident light and the light control variable.

A display device according to a fifth aspect is the device of any one of the first through fourth aspects, wherein the intensity of light incident on the display element after adjusting the intensity of light and the light control variable by the adjusting means is smaller than the intensity of light incident on the display element without performing the adjustments. In the fifth aspect, an adjustment is made so that the intensity of light incident on the display element after adjusting the intensity of light and the light control variable is smaller than the intensity of incident light without performing the adjustments. It is thus possible to certainly reduce the power consumed by the light source.

A display device according to a sixth aspect is the device of any one of the first through fifth aspects, wherein an incident region of light incident on the display element is divided, and the detection of a grayscale level by the detecting means and the adjustments of the intensity of light and the light control variable by the adjusting means are performed for each of the divided incident regions. In the sixth aspect, the detection of a grayscale level and the adjustments of the intensity of light and the light control variable are performed for each of the divided incident regions of light incident on the display element. Thus, since finer adjustments can be made, it is possible to increase the ratio of the time in which the intensity of incident light can be decreased and achieve a further reduction in power consumption.

A display device according to a seventh aspect is the device of any one of the first through sixth aspects, wherein the display element is a liquid crystal display element. In the seventh aspect, since a liquid crystal display element is used as the display element, it is possible to achieve a small-size, thin direct-view type display device and a projection-type display device capable of realizing a large-size display.

A display device according to an eighth aspect is the device of the seventh aspect, wherein a liquid crystal material used in the liquid crystal display element has spontaneous polarization. In the eighth aspect, since a liquid crystal material having spontaneous polarization, for example, a ferroelectric liquid crystal material or an anti-ferroelectric liquid crystal material, is used as the liquid crystal material, it is possible to easily achieve a high-speed responsiveness of 2 ms or less, which is necessary for a field-sequential type liquid crystal display device, and perform stable display.

A display device according to a ninth aspect is the device of any one of the first through sixth aspects, wherein the display element is a DMD (Digital Micro Mirror Device). In the ninth aspect, since a DMD is used as the display element, it is possible to easily achieve a projection-type display device capable of realizing a large-size display.

A display device according to a tenth aspect is the device of any one of the first through ninth aspects, wherein the lights of a plurality of colors to be incident on the display element are red light, green light, and blue light. A display device according to an eleventh aspect is the device of any one of the first through ninth aspects, wherein the lights of a plurality of colors to be incident on the display element are red light, green light, blue light, and white light. In the tenth or eleventh aspect, it is possible to achieve a full-color display.

A display device according to a twelfth aspect is the device of the eleventh aspect, and further comprises converting means for converting red, green and blue display data into red, green, blue and white display data, wherein the detecting means detects grayscale levels of the display data obtained by the converting means. In the case where the grayscale levels r, g, and b of red, green and blue display data are converted into the grayscales levels of four-color display data, namely, $r'=r-w$, $g'=g-w$, $b'=b-w$, and w, by the grayscale level w of white display data that is a common portion of the three colors, the grayscale level w of white is generally the lowest grayscale level among the grayscale levels r, g, and b of red, green and blue, and at least one of the grayscale levels r', g', and b' after conversion becomes 0. Further, in the case where the intensity of incident light and the transmittance are adjusted based on these grayscale levels r', g', b', and w after conversion, it is possible to achieve a full-color display with lower power consumption and prevent a color break.

A color-filter type display device according to a thirteenth aspect comprises: detecting means for detecting a grayscale level of display data; and adjusting means for adjusting an intensity of white light incident on a display element and a light control variable in the display element, based on a detection result of the detecting means. A color-filter type display method according to a fifteenth aspect detects a grayscale level of display data, and adjusts an intensity of white light incident on a display element and a light control variable in the display element, based on a detection result of the grayscale level.

The characteristics of the above-described first through ninth and fourteenth aspects are not limited to field-sequential type display devices and display methods, and are also applicable to the color-filter type display device (the thirteenth aspect) and display method (the fifteenth aspect) for performing a color display by providing a display element with color filters of a plurality of colors (red, green, and blue) and causing white light to be incident on the display element from a light source.

The above and further objects and features of the invention will more fully be apparent from the following detailed description with accompanying drawings.

DETAILED DESCRIPTION OF THE INVENTION

The following description will specifically explain the present invention with reference to the drawings illustrating some embodiments thereof. Note that although field-sequential type liquid crystal display devices using a transmission type liquid crystal display element as a display element and an LED array as a light source will be illustrated as examples, the present invention is not limited to the following embodiments.

First Embodiment

Figure 5:
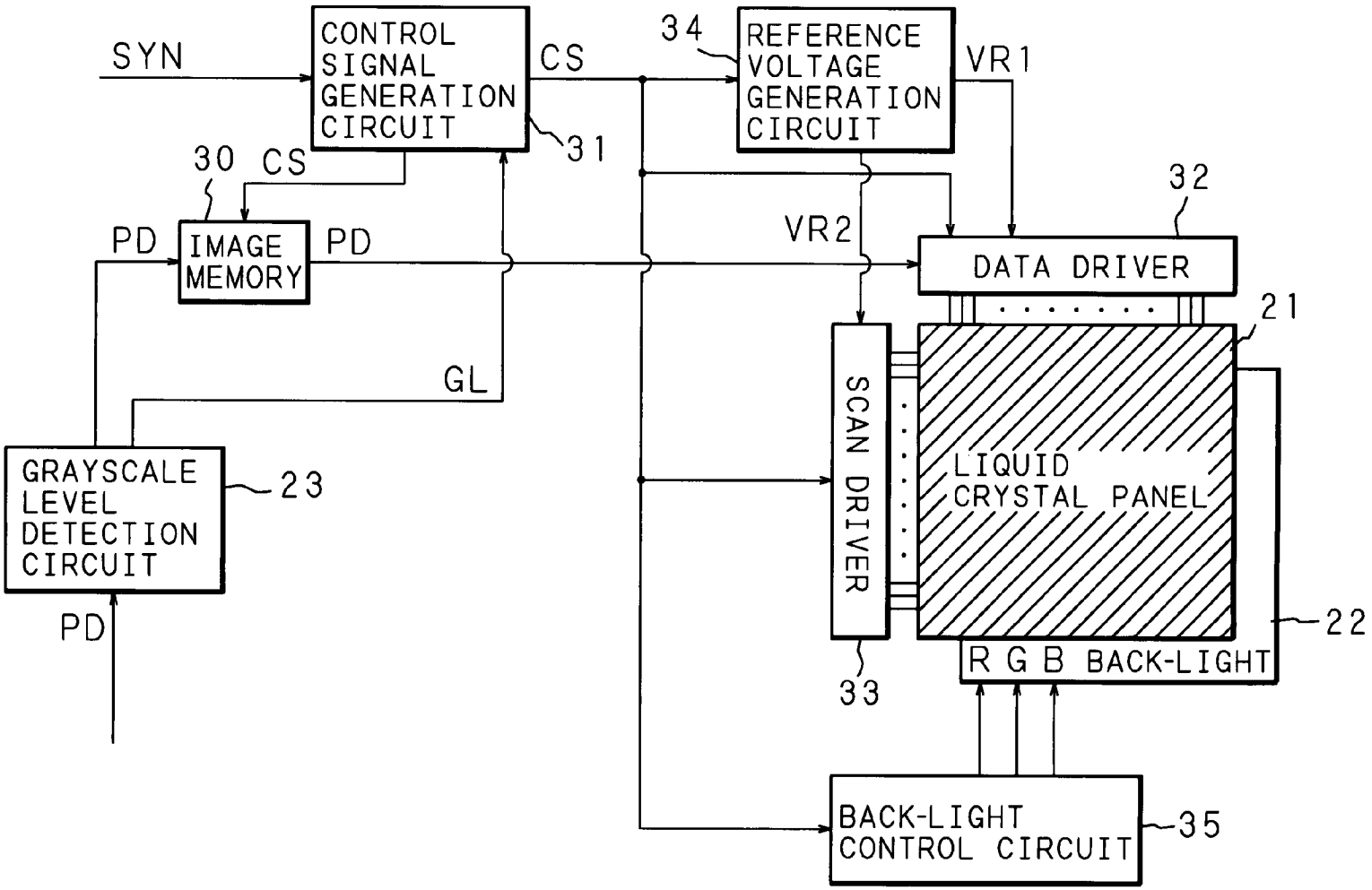
FIG. 5 is a block diagram showing the circuit structure of the liquid crystal display device (the first and second embodiments) of the present invention.
Figure 6:
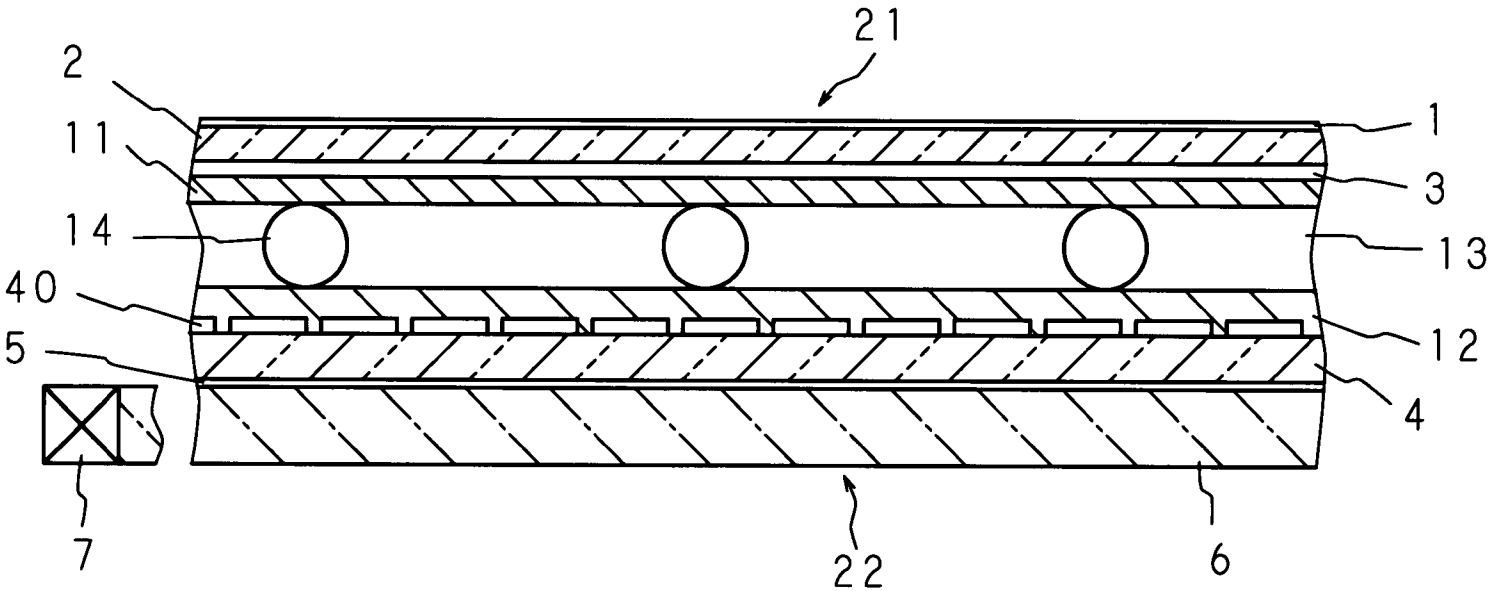
FIG. 6 is a schematic cross sectional view of a liquid crystal panel and a back-light.
Figure 7:
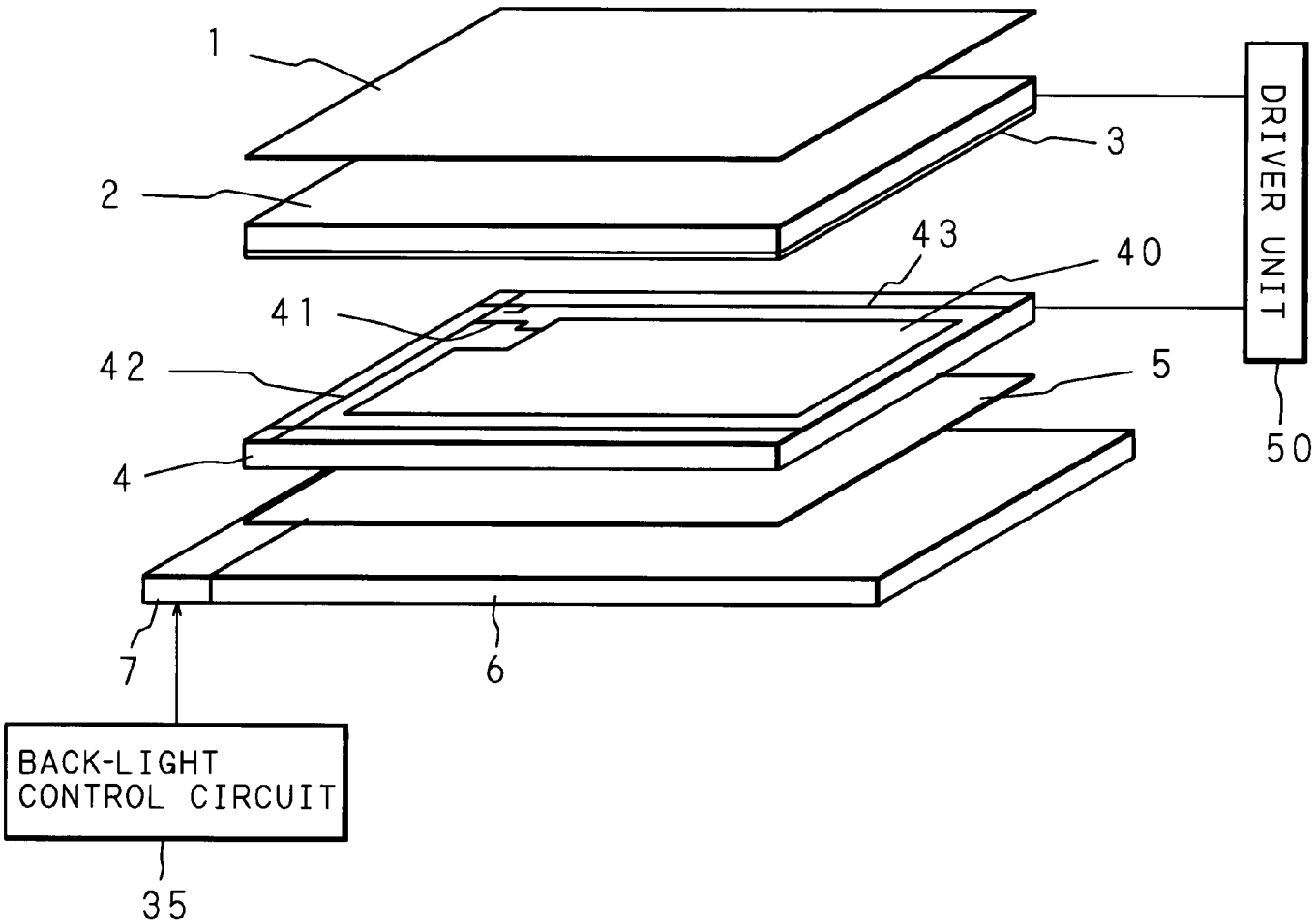
FIG. 7 is a schematic view showing an example of the overall structure of the liquid crystal display device.
Figure 8:
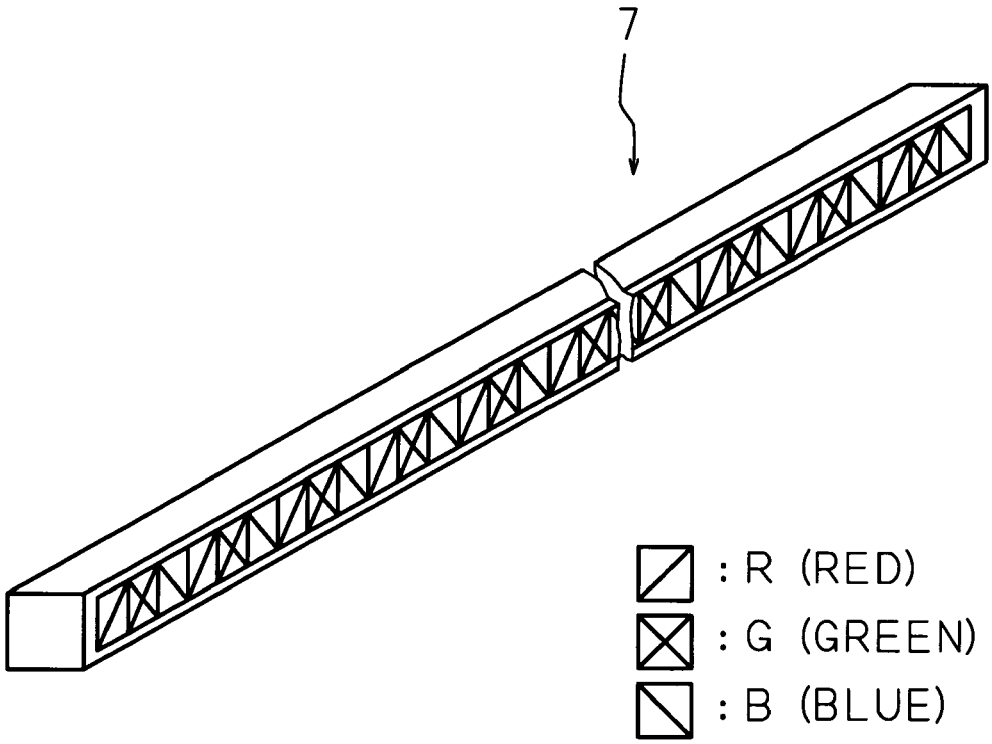
FIG. 8 is a view showing an example of the structure of an LED array.

FIG. 5 is a block diagram showing the circuit structure of a liquid crystal display device of the first embodiment; FIG. 6 is a schematic cross sectional view of a liquid crystal panel and a back-light; FIG. 7 is a schematic view showing an example of the overall structure of the liquid crystal display device;

and FIG. 8 is a view showing an example of the structure of an LED array as a light source of the back-light.

In FIG. 5, the numerals 21 and 22 represent a liquid crystal panel and a back-light whose cross sectional structures are shown in FIG. 6. As shown in FIG. 6, the back-light 22 comprises an LED array 7 for emitting light of each of red, green and blue colors, and a light guiding/diffusing plate 6.

As shown in FIGS. 6 and 7, the liquid crystal panel 21 comprises a polarization film 1, a glass substrate 2, a common electrode 3, a glass substrate 4 and a polarization film 5, which are stacked in this order from the upper layer (front face) side to the lower layer (rear face) side, and pixel electrodes 40 which are arranged in matrix form on the common electrode 3 side of the glass substrate 4.

A driver unit 50 comprising a data driver 32 and a scan driver 33 is connected between the common electrode 3 and the pixel electrodes 40. The data driver 32 is connected to TFTs 41 through signal lines 42, while the scan driver 33 is connected to the TFTs 41 through scanning lines 43. The TFTs 41 are controlled to be on/off by the scan driver 33. Moreover, each of the pixel electrodes 40 is connected to a TFT 41. Therefore, the intensity of transmitted light of each individual pixel is controlled by a signal given from the data driver 32 through the signal line 42 and the TFT 41.

An alignment film 12 is provided on the upper face of the pixel electrodes 40 on the glass substrate 4, while an alignment film 11 is placed on the lower face of the common electrode 3. The space between these alignment films 11 and 12 is filled with a liquid crystal material so as to form a liquid crystal layer 13. Besides, the numeral 14 represents spacers for maintaining a layer thickness of the liquid crystal layer 13.

A back-light 22 is disposed on the lower layer (rear face) side of the liquid crystal panel 21, and has the LED array 7 placed to face an end face of the light guiding/diffusing plate 6 that forms a light emitting area. As shown in FIG. 8, this LED array 7 includes LEDs for emitting light of the three primary colors, namely red (R), green (G) and blue (B), the LEDs being arranged sequentially and repeatedly on a face facing the light guiding/diffusing plate 6. The red, green and blue LEDs are turned on in red, green and blue sub-frames, respectively. The light guiding/diffusing plate 6 guides the light emitted from each LED of this LED array 7 to its entire surface and diffuses it to the upper face, thereby functioning as the light emitting area.

This liquid crystal panel 21 and the back-light 22 capable of emitting red light, green light and blue light in a time-divided manner are stacked one upon another. The ON timing and the colors of emitted light of the back-light 22 are controlled in synchronism with the image data writing scanning/erasing scanning of the liquid crystal panel 21.

In FIG. 5, the numeral 23 is a grayscale level detection circuit into which image data (display data) PD corresponding to an image to be displayed is inputted from an external device, for example, a personal computer, and which detects the grayscale level for each of the colors (red, green, and blue). The grayscale level detection circuit 23 outputs a grayscale level signal GL indicating a grayscale level of the image data PD detected for each color (red, green, blue) to a control signal generation circuit 31. The control signal generation circuit 31 is supplied with a synchronous signal SYN from the personal computer, and generates various control signals CS necessary for display. The image data PD is outputted from an image memory 30 to the data driver 32 for each pixel.

Based on the image data PD and the control signal CS for changing the polarity of applied voltage, voltages which are different in polarity and substantially equal in magnitude are applied to the liquid crystal panel 21 through the data driver 32 when performing data writing scanning and data erasing scanning, respectively.

A reference voltage generation circuit 34 generates reference voltages VR1 and VR2, and outputs the generated reference voltages VR1 and VR2 to the data driver 32 and the scan driver 33, respectively. The data driver 32 outputs signals to the signal lines 42 of the pixel electrodes 40 based on the image data PD from the image memory 30 and the control signals CS from the control signal generation circuit 31. In synchronism with the output of the signals, the scan driver 33 scans the scanning lines 43 of the pixel electrodes 40 sequentially on a line by line basis. Further, a back-light control circuit 35 applies a drive voltage to the back-light 22 so as to cause each of the red, green and blue LEDs of the LED array 7 of the back-light 22 to emit light in a time divided manner.

The control signal CS generated in the control signal generation circuit 31 based on the grayscale level signal GL from the grayscale level detection circuit 23 is sent to the back-light control circuit 35 and the data driver 32. According to the control signal CS, the intensity of light incident on the liquid crystal panel 21 as a display element from the back-light 22 as a light source and the light control variable (switching variable) in the liquid crystal panel 21 are adjusted.

Next, the operation of the liquid crystal display device of the present invention will be explained. The image data PD for display is inputted to the grayscale level detection circuit 23 from the personal computer, the grayscale level of each of the red, green and blue colors is detected, and the grayscale level signals GL indicating the detection results are sent to the control signal generation circuit 31. After storing the image data PD temporarily, the image memory 30 outputs the image data PD pixel by pixel upon receipt of the control signal CS outputted from the control signal generation circuit 31. The control signal CS generated by the control signal generation circuit 31 is supplied to the data driver 32, scan driver 33, reference voltage generation circuit 34, and back-light control circuit 35. The reference voltage generation circuit 34 generates reference voltages VR1 and VR2 upon receipt of the control signal CS, and outputs the generated reference voltages VR1 and VR2 to the data driver 32 and the scan driver 33, respectively.

When the data driver 32 receives the control signal CS, it outputs a signal to the signal lines 42 of the pixel electrodes 40, based on the image data PD outputted from the image memory 30. When the scan driver 33 receives the control signal CS, it scans the scanning lines 43 of the pixel electrodes 40 sequentially on a line by line basis. According to the output of the signal from the data driver 32 and the scanning by the scan driver 33, the TFTs 41 are driven and voltage is applied to the pixel electrodes 40, thereby controlling the intensity of transmitted light of the pixels. The transmittance at this time is adjusted based on the grayscale level of the image data.

When the back-light control circuit 35 receives the control signal CS, it applies a drive voltage adjusted based on the grayscale levels of the image data to the back-light 22 so as to cause the red, green and blue LEDs of the LED array 7 of the back-light 22 to emit light in a time-divided manner, thereby emitting red light, green light, and blue light sequentially with passage of time.

Concrete examples are illustrated below. After washing a TFT substrate having pixel electrodes 40 (pixel number: 640×480, diagonal: 3.2 inches) and a glass substrate 2 having a common electrode 3, they were coated with polyimide and baked for one hour at 200° C. so as to form about 200 Å thick polyimide films as alignment films 11 and 12. Further, these alignment films 11 and 12 were rubbed with a rayon fabric, and an empty panel was produced by stacking these two substrates so that the rubbing directions are parallel and maintaining a gap therebetween by spacers 14 made of silica having an average particle size of 1.8 μm. A ferroelectric liquid crystal material, which has a half-V-shaped electro-optic response characteristic shown in FIG. 9 when TFT-driven, was sealed between the alignment films 11 and 12 of this empty panel so as to form the liquid crystal layer 13. The magnitude of spontaneous polarization of the sealed ferroelectric liquid crystal material was 8 $nC/cm^2$. The liquid crystal panel 21 was produced by sandwiching the fabricated panel by two polarization films 1 and 5 arranged in a crossed-Nicol state, and a dark state was produced in the absence of applied electric field.

The liquid crystal panel 21 thus fabricated and the above-described back-light 22 comprising the LED array 7 capable of switching surface emission of monochrome colors, red, green and blue, as a light source are stacked one upon another, and color display is performed by a field-sequential method, according to a later-described drive sequence.

Figure 4:
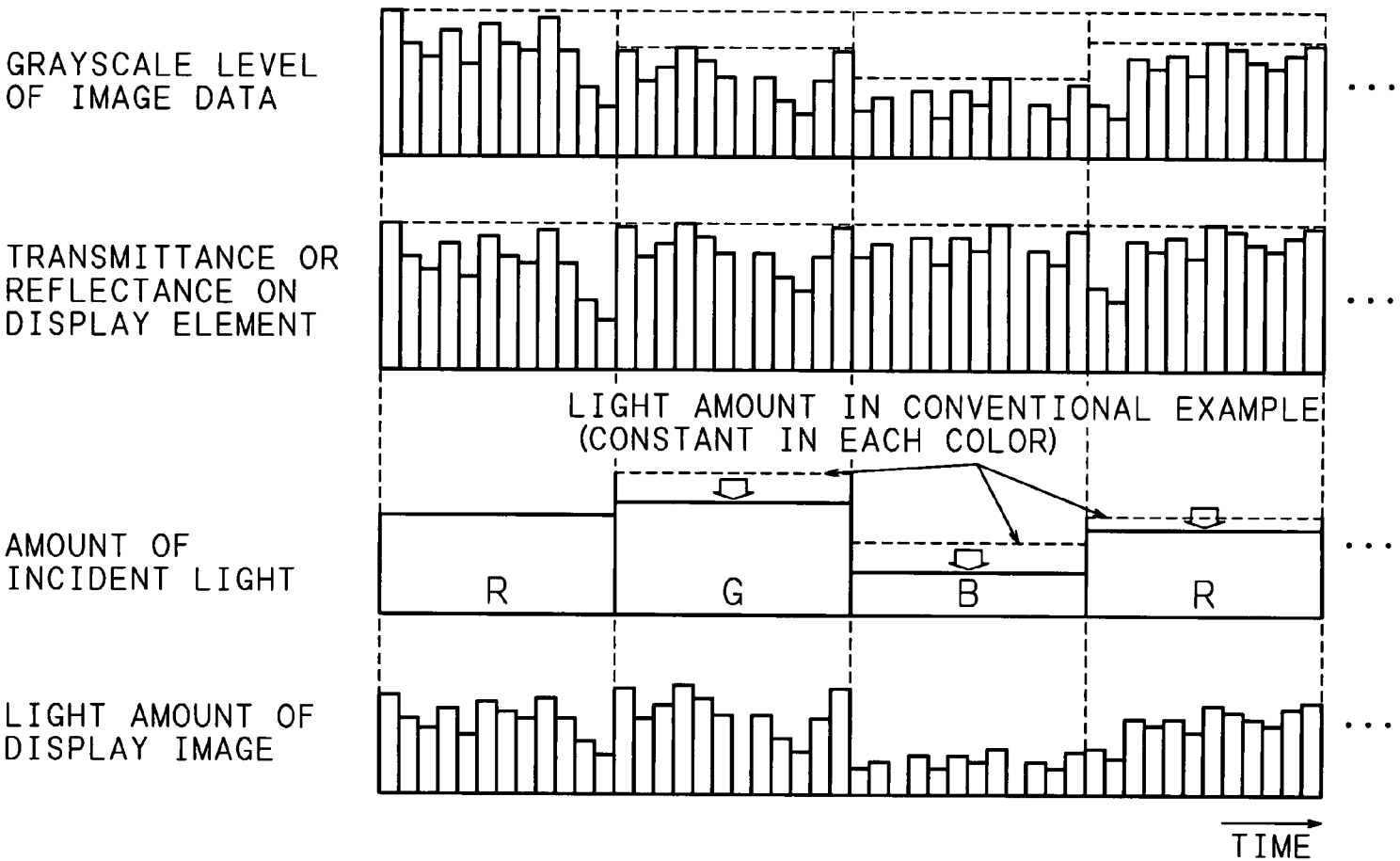
FIG. 4 is a view for explaining the concept of a field-sequential type display device of the present invention.

Based on the above-described concept of the present invention shown in FIG. 4, the grayscale levels of the red, green and blue image data are detected in each sub-frame, and the intensity of light incident on the liquid crystal panel 21 from the back-light 22 and the transmittance of the liquid crystal panel 21 are adjusted. More specifically, the transmittance of the liquid crystal panel 21 is adjusted so as to have maximum transmittance for the image data that requires the maximum amount of transmitted light in each of the red, green and blue sub-frames, and the intensity of incident light is reduced according to the adjustment result of the transmittance.

Figure 10:
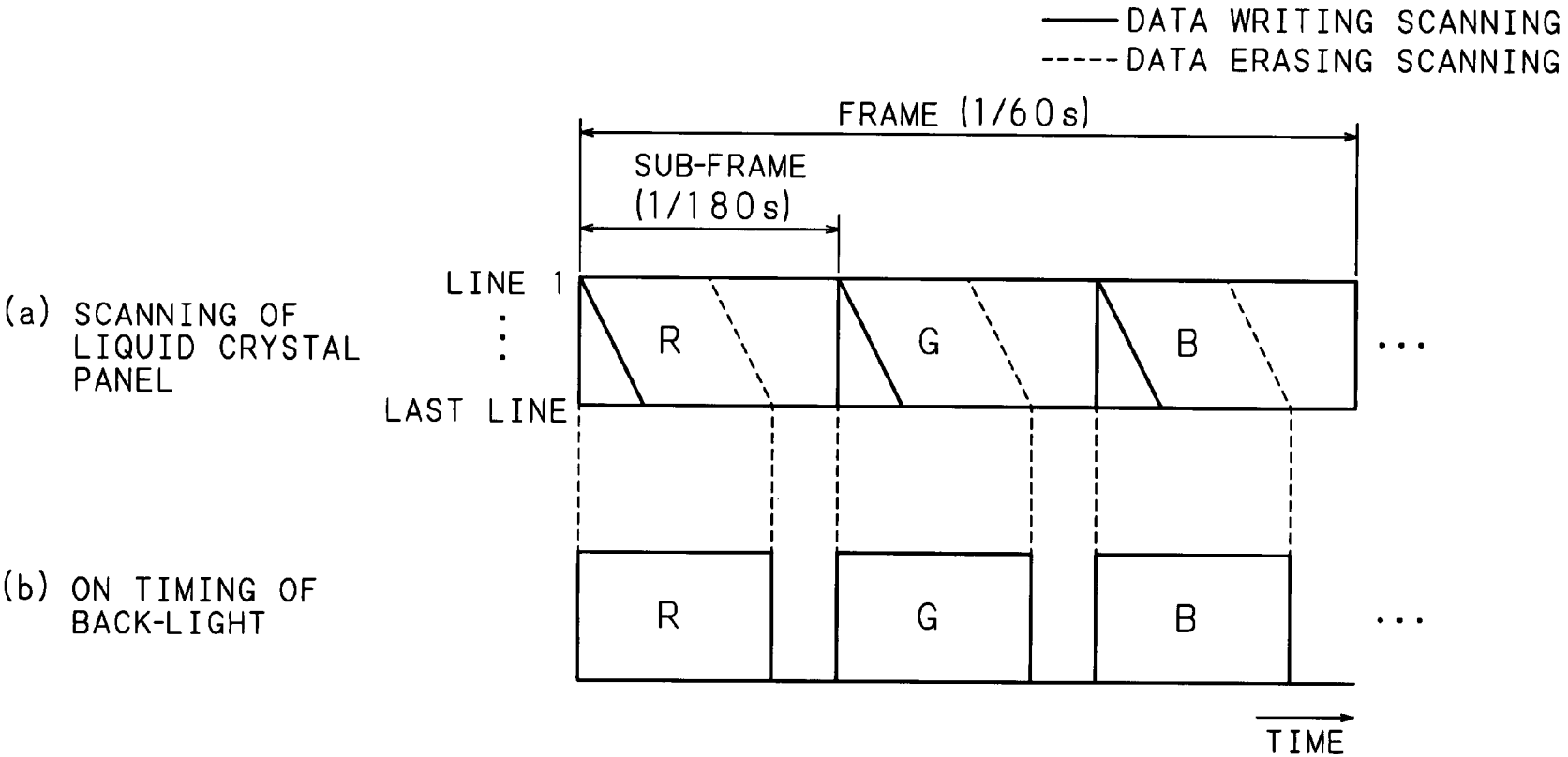
FIG. 10 show a time chart of display control in the liquid crystal display device (the first embodiment) of the present invention.

FIG. 10 show a time chart of display control, wherein FIG. 10(*a*) shows the scanning timing of each line of the liquid crystal panel 21, and FIG. 10(*b*) shows the ON timing of red, green and blue colors of the back-light 22 (LED). One frame (1/60 s) is divided into three sub-frames, and, for example, writing/erasing scanning of red image data is performed by turning on the red LED in the first sub-frame, writing/erasing scanning of green image data is performed by turning on the green LED in the next second sub-frame, and writing/erasing scanning of blue image data is performed by turning on the blue LED in the last third sub-frame within one frame. In short, image data scanning is performed twice in each sub-frame, and the color and intensity are switched in each sub-frame.

Figure 9:
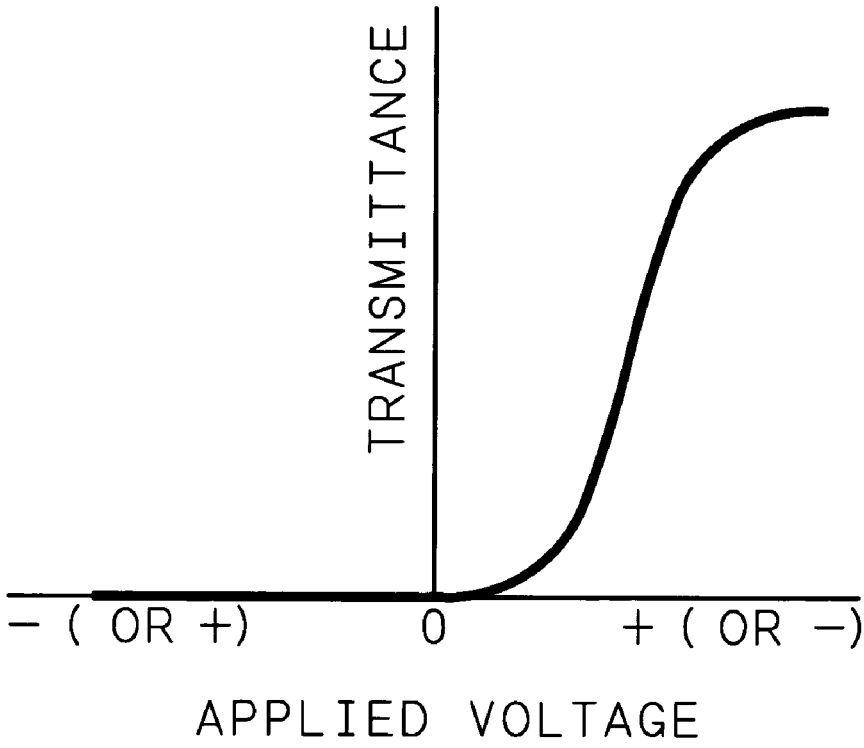
FIG. 9 is a graph showing the electro-optic characteristics of a liquid crystal material used in the present invention.

Note that the voltages applied to the liquid crystal of each pixel in the writing scanning and the erasing scanning are substantially equal in magnitude but opposite in polarity. Accordingly, since the sealed liquid crystal material has the characteristic as shown in FIG. 9, an image of high transmittance is displayed by the first scanning (data writing scanning), and an image of lower transmittance (substantially 0) than the first scanning is obtained by the second scanning (data erasing scanning). Consequently, it is possible to obtain images with no display irregularity and reduce the deviation of applied voltage, thereby preventing image sticking of display.

As described above, by detecting the grayscale levels of the red, green and blue image data in each sub-frame and adjusting the intensity of incident light on the liquid crystal panel 21 and the transmittance of the liquid crystal panel 21, it is possible to reduce the power consumed by the back-light 22 compared to a later-described comparative example and achieve a reduction in power consumption. Note that the display characteristics are equivalent to those in the comparative example, and deterioration in the image quality is not seen.

Comparative Example

Figure 1:
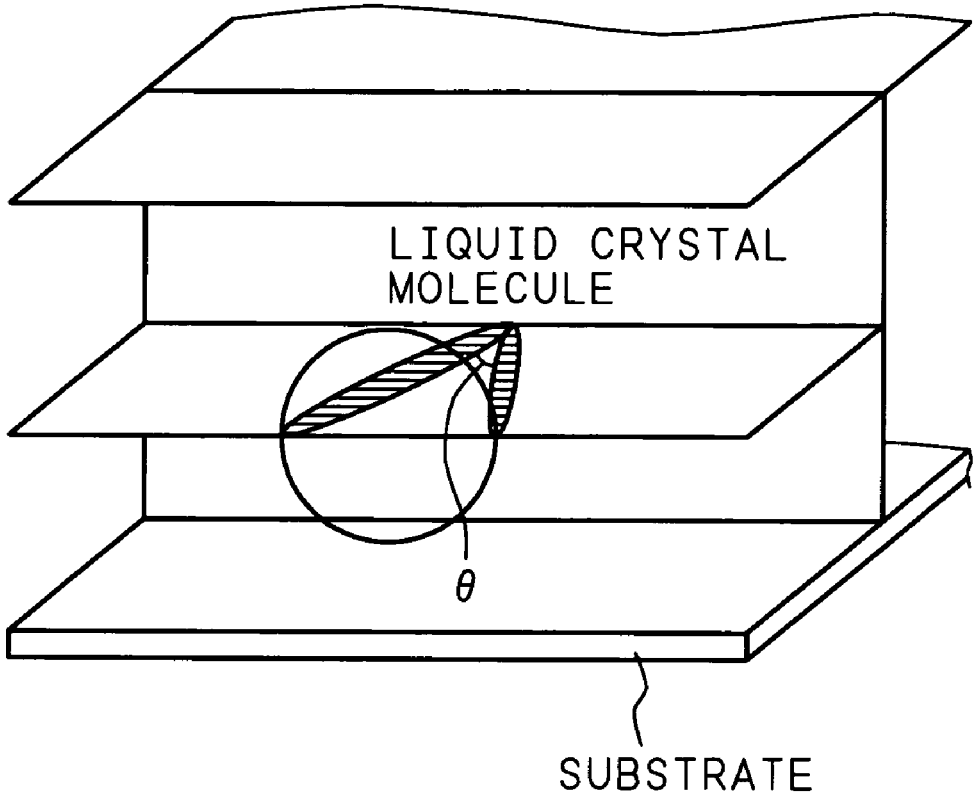
FIG. 1 PRIOR ART
FIG. 1 is an illustration showing an alignment state of a liquid crystal molecule in a ferroelectric liquid crystal panel.
Figure 2:
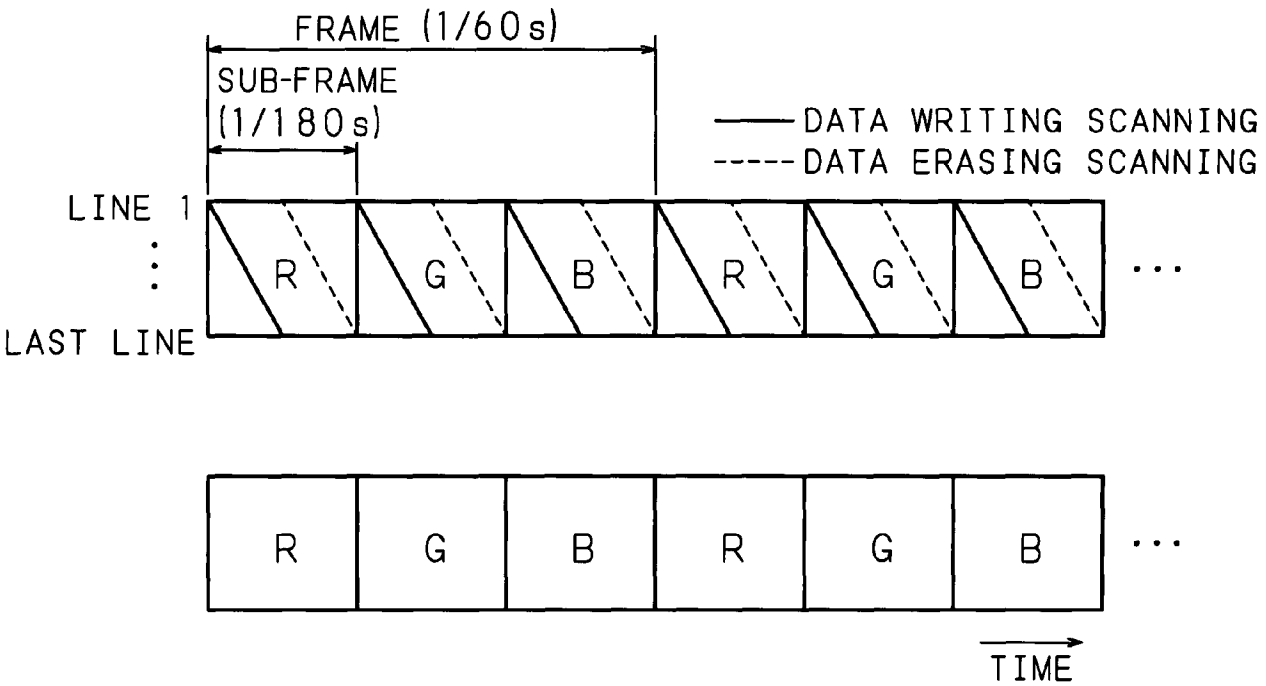
FIG. 2 PRIOR ART
FIG. 2 show a time chart of display control in a conventional liquid crystal display device.
Figure 3:
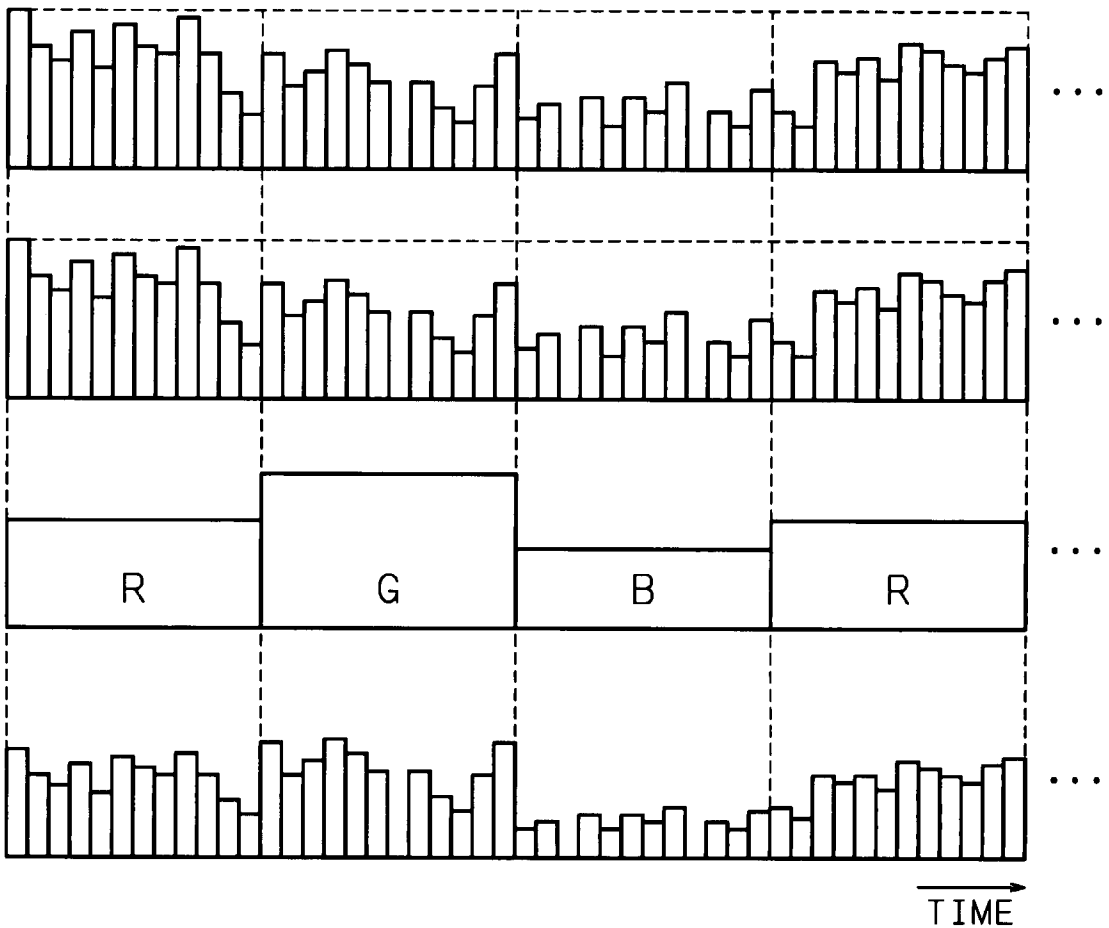
FIG. 3 PRIOR ART
FIG. 3 is a view for explaining the concept of a conventional field-sequential type display device.

With the use of the same liquid crystal panel and back-light as those in the above-described first embodiment, color display is performed according to a drive sequence shown in FIG. 10 similarly to the first embodiment. However, as illustrated in FIG. 3, the intensity of incident light of each color on the liquid crystal panel is made constant at all times for each color.

As a result, almost all the displayed images consume more power compared to the first embodiment. The reason for this is that the intensity of emitted light of each color of the back-light is constant irrespective of the grayscale level of image data, i.e., the intensity of emitted light for a very dark image is the same as that for a bright image, and consequently a lot of power is wasted.

Second Embodiment

In the second embodiment, the light emitting region of the back-light is divided into a plurality of regions, and the adjustments of intensity of incident light and transmittance based on a grayscale level of image data of the present invention are performed for each divided region. Since the structure of the liquid crystal panel to be used and the circuit structure of the liquid crystal display device are the same as those in the above-described first embodiment, the explanation thereof is omitted.

Figure 11:
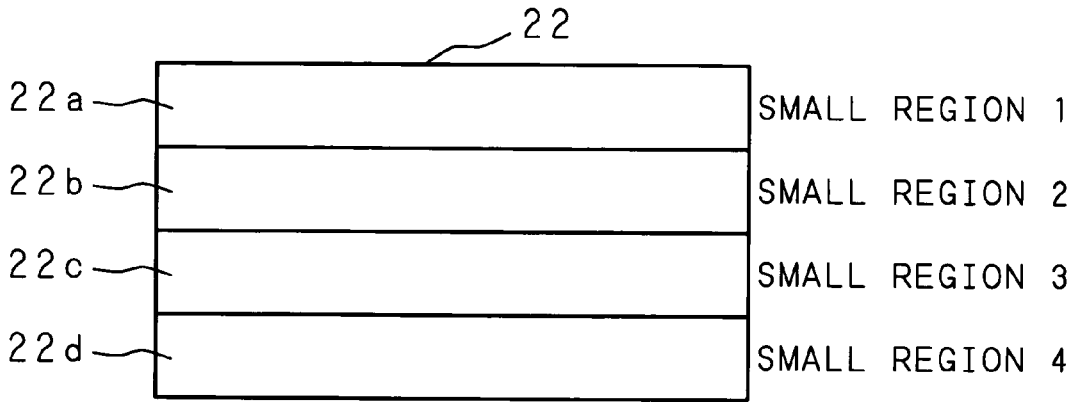
FIG. 11 is a view showing an example of dividing the back-light of the liquid crystal display device (the second and third embodiments) of the present invention.

By dividing the region of the back-light 22 into four small regions 22*a* through 22*d* as shown in FIG. 11, the light incident region on the liquid crystal panel 21 is divided into four small incident regions. Then, the grayscale levels of red, green, blue image data are detected for each of the small incident regions in each sub-frame, and the intensity of incident light on the liquid crystal panel 21 from the back-light 22 and the transmittance of the liquid crystal panel 21 are adjusted based on the detection result. More specifically, the transmittance of the liquid crystal panel 21 is adjusted so as to have maximum transmittance for the image data that require a maximum amount of transmitted light in each of the small regions within each of the red, green and blue sub-frames, and the intensity of incident light is reduced according to the adjustment result of the transmittance.

Figure 12:
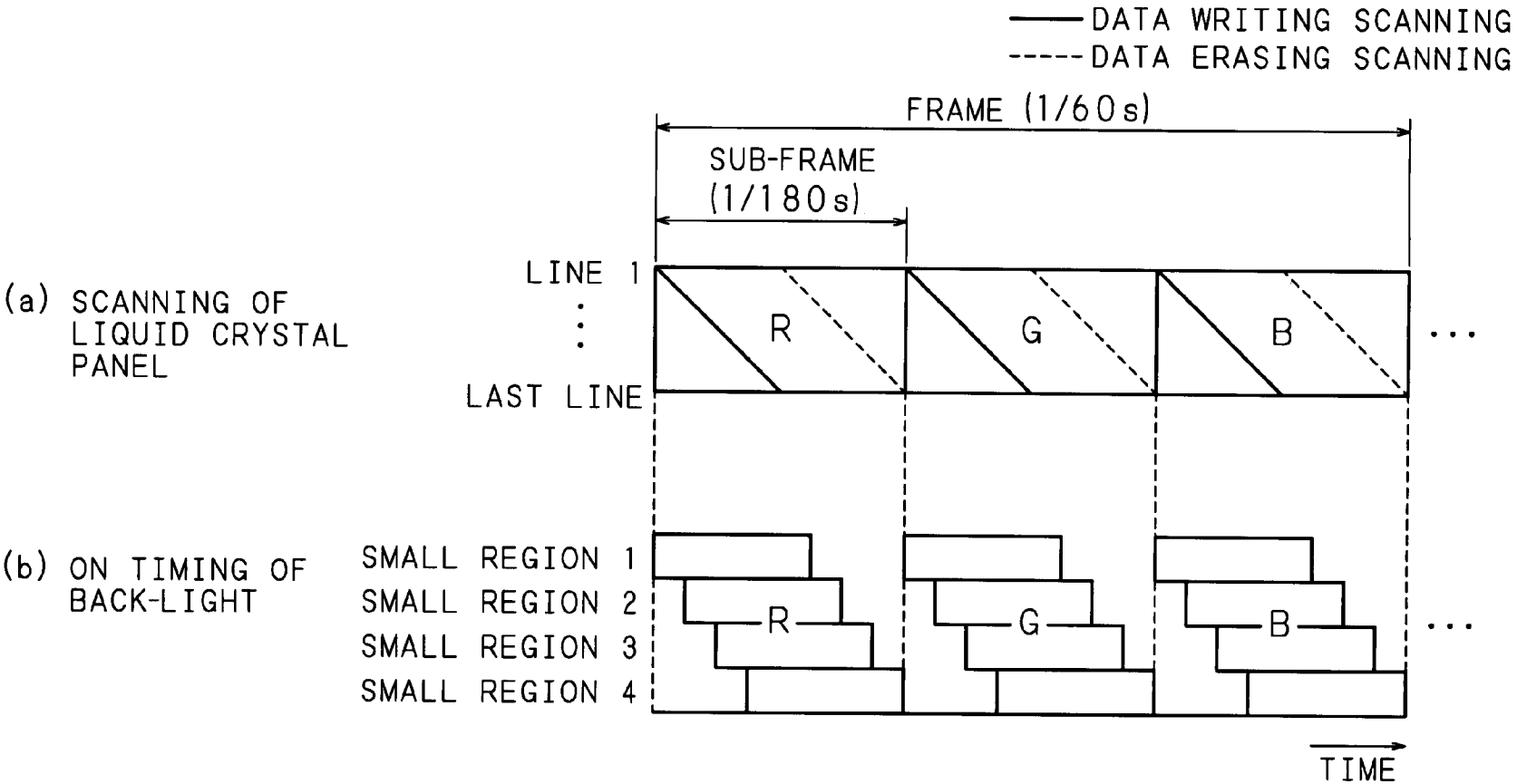
FIG. 12 show a time chart of display control in the liquid crystal display device (the second embodiment) of the present invention.

FIG. 12 show a time chart of display control, wherein FIG. 12(*a*) shows the scanning timing of each line of the liquid crystal panel 21, and FIG. 12(*b*) shows the ON timing of red, green and blue colors of the back-light 22 (LED). The turning on of the back-light 22 is controlled for each of the four small regions in one sub-frame. Then, image data scanning is performed twice in each sub-frame, and the intensity of incident light on the liquid crystal panel 21 and the transmittance of the liquid crystal panel 21 are switched for each of the small regions in each sub-frame. The contents of the data scanning performed twice in each sub-frame are the same as those in the first embodiment shown in FIG. 10. Note that in the image data scanning performed twice in the second embodiment, the end timing of the first scanning coincides with the start timing of the second scanning.

As described above, by detecting the grayscale levels of red, green and blue image data for each of the divided small regions in each sub-frame and adjusting the intensity of incident light on the liquid crystal panel 21 and the transmittance of the liquid crystal panel 21 based on the detection result, it is possible to further reduce the power consumed by the back-light 22 and achieve a further reduction in power consumption. Note that the display characteristics are equivalent to those in the first embodiment and comparative example, and deterioration in the image quality is not seen.

Third Embodiment

In the third embodiment, inputted image data of three colors, red, green and blue, are converted into image data of four colors, red, green, blue and white, and full-color display is performed by using the converted image data of four colors. First, the conversion technique is explained.

Figure 13:
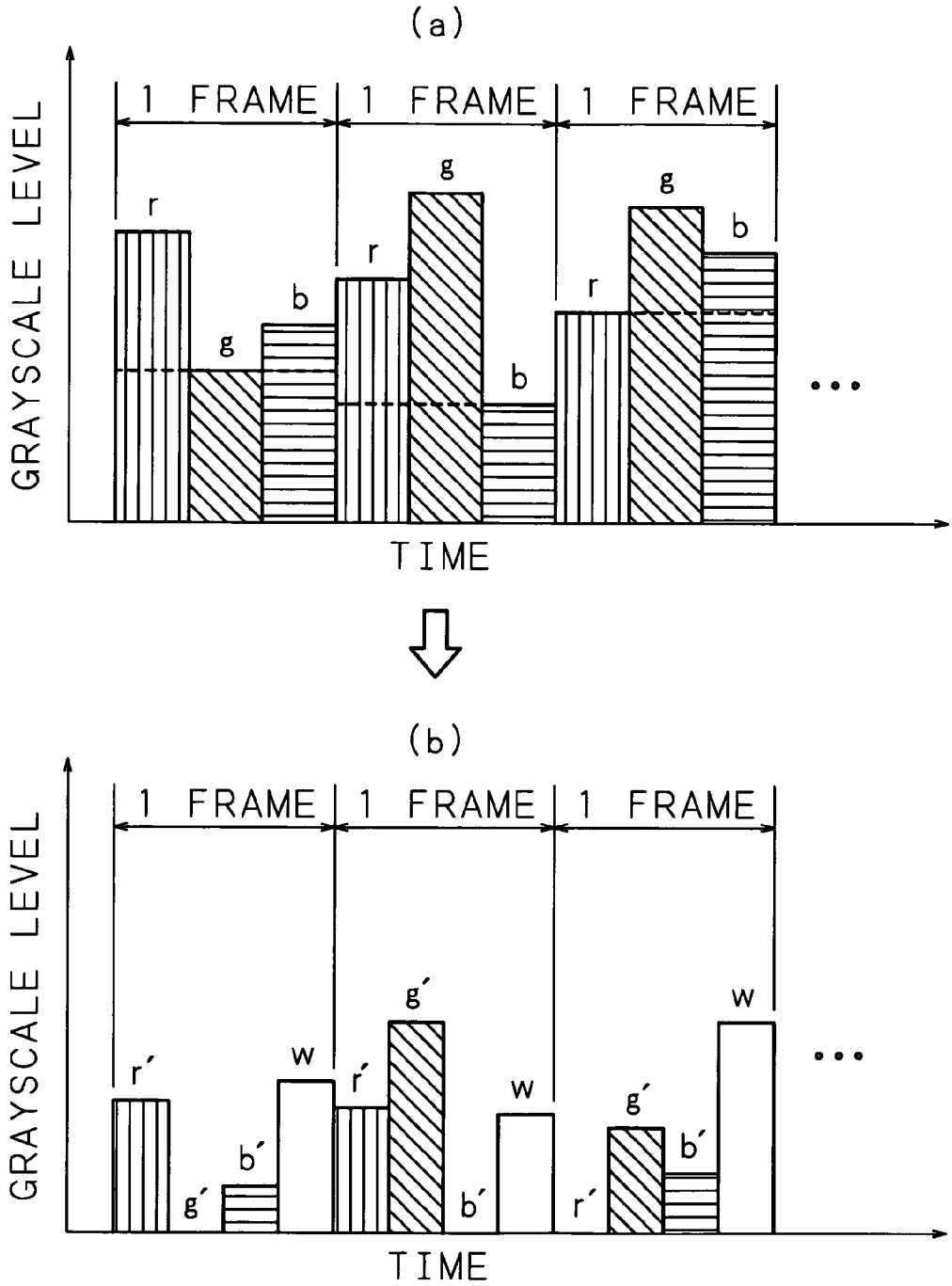
FIG. 13 are views showing an example of converting image data in the liquid crystal display device (the third embodiment) of the present invention.

FIG. 13(*a*) shows the original grayscale levels of red (r), green (g) and blue (b) in each frame, and FIG. 13(*b*) shows the grayscale levels of red (r'), green (g'), blue (b') and white (w) in each frame after conversion. In each frame, the grayscale levels of the red, green and blue image data are compared so as to detect the lowest grayscale level. For example, in the first frame shown in FIG. 13(*a*), the grayscale level of the green display data is the lowest. In this case, in the sub-frames of red display and blue display, red and blue are displayed according to grayscale levels ($r'=r-g$, $b'=b-g$) which are obtained by subtracting the grayscale level (g) of green from the respective grayscale levels (r, b) of red and blue before comparison.

In a sub-frame of white display that is a mixed color of red, green and blue, a white display ($w=g$) according to the grayscale level (g) of green is performed. Besides, in the sub-frame of green display, a green display according to a grayscale level ($g'=g\cdot g$) obtained by subtracting the grayscale level (g) of green from the grayscale level (g) of green before comparison is performed. However, since the grayscale level (g') resulting from the subtraction is 0, this display is generally a "black image". With such a conversion process, since the maximum amount of transmitted light in each sub-frame becomes smaller compared to the case where such a conversion process is not performed, it is possible to achieve a further reduction in power consumption.

Figure 14:
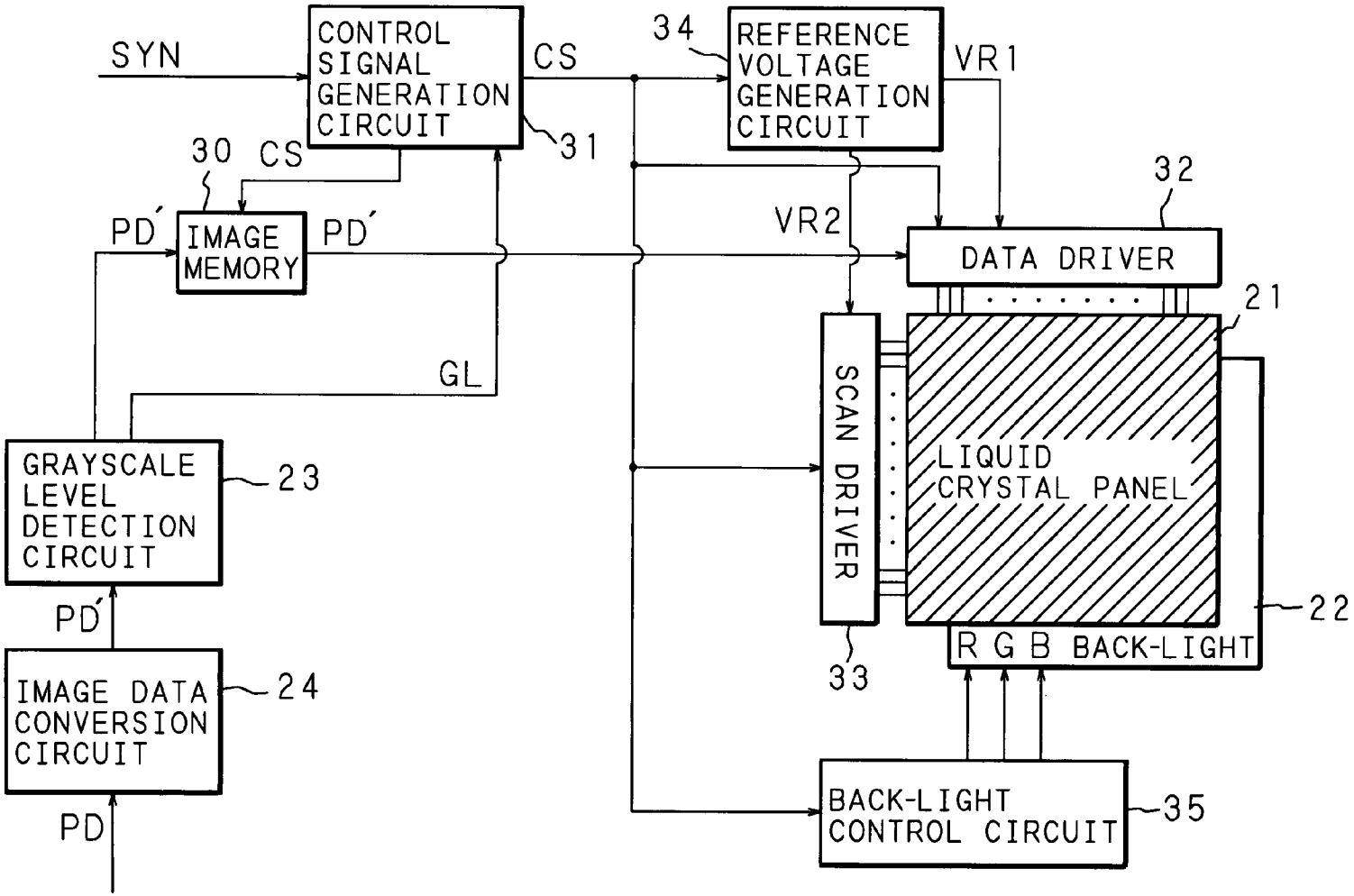
FIG. 14 is a block diagram showing the circuit structure of the liquid crystal display device (the third embodiment) of the present invention.

FIG. 14 is a block diagram showing the circuit structure of the liquid crystal display device of the third embodiment. In FIG. 14, the members same as or similar to those in FIG. 5 are designated with the same numeric numbers. The structure of the liquid crystal panel 21 is the same as that in the first embodiment, and the back-light 22 is divided into four small regions in the same manner as in the second embodiment. Note that in a white sub-frame, the red, green and blue LEDs of the LED array 7 are simultaneously turned on.

In FIG. 14, the numeral 24 is an image data conversion circuit for converting three-color image data PD inputted from an external device such as a personal computer into four-color image data PD' for display according to the above-described technique, and the image data conversion circuit 24 outputs the converted image data PD' to the grayscale level detection circuit 23. The grayscale level detection circuit 23 outputs the grayscale level signal GL indicting the grayscale level of the image data PD' detected for each color (red, green, blue, white) to the control signal generation circuit 31. The control signal CS generated in the control signal generation circuit 31 based on the grayscale level signal GL from the grayscale level detection circuit 23 is sent to the back-light control circuit 35 and the data driver 32. According to the control signal CS, the intensity of light incident on the liquid crystal panel 21 from the back-light 22 and the transmittance of the liquid crystal panel 21 are adjusted for each of the small regions within each sub-frame.

Note that since the structures and operations of other members such as the data driver 32, scan driver 33 and reference voltage generation circuit 34 are basically the same as those in the first embodiment, except that the image data PD is changed to converted image data PD', the explanation thereof is omitted.

Figure 15:
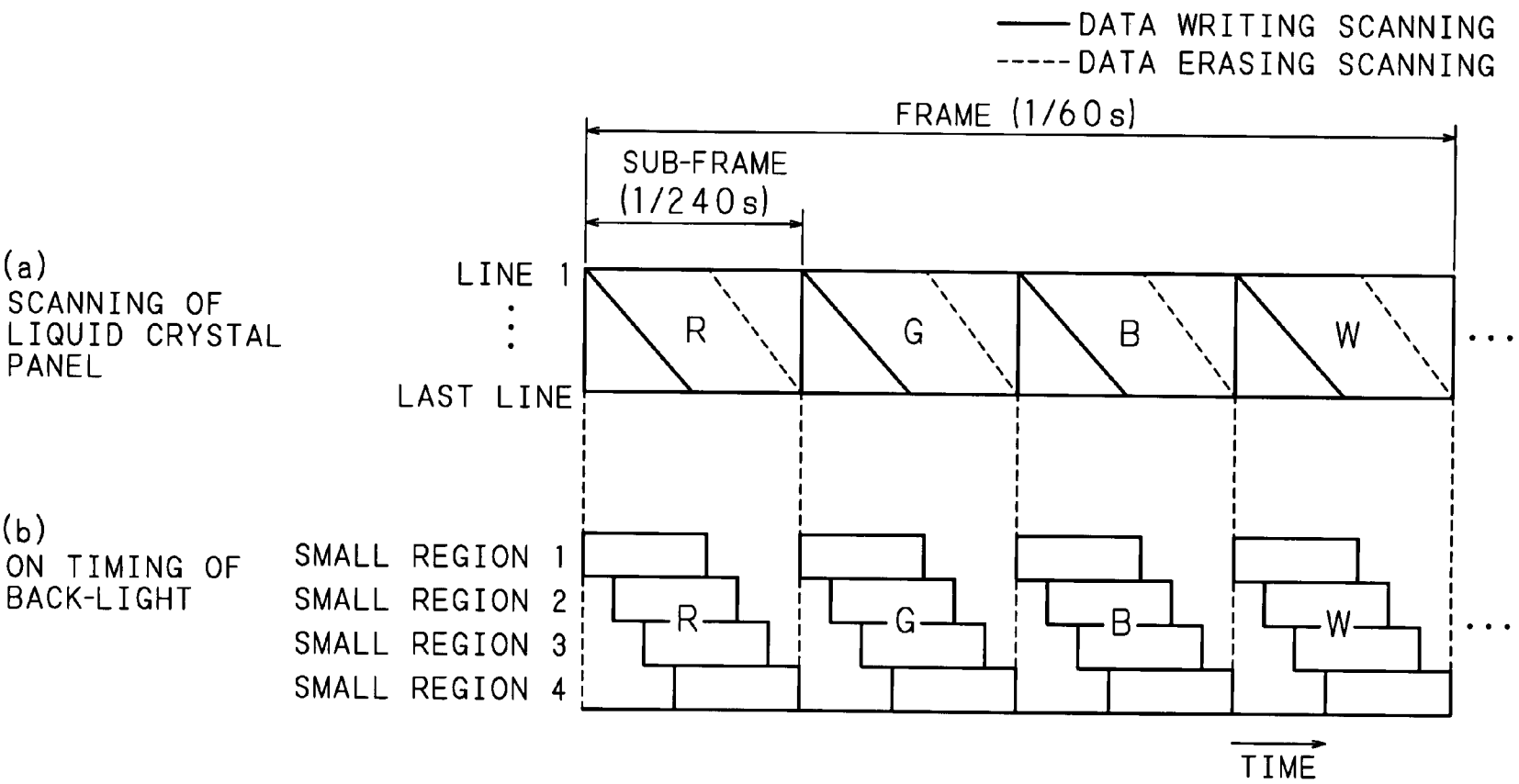
FIG. 15 show a time chart of display control in the liquid crystal display device (the third embodiment) of the present invention.

FIG. 15 show a time chart of display control, wherein FIG. 15(*a*) shows the scanning timing of each line of the liquid crystal panel 21, and FIG. 15(*b*) shows the ON timing of red, green, blue and white colors of the back-light 22 (LED). The turning on of the back-light 22 is controlled for each of the four small regions within one sub-frame. Further, image data scanning is performed twice in each sub-frame, and the intensity of incident light on the liquid crystal panel 21 and the transmittance of the liquid crystal panel 21 are switched for each of the small regions within each sub-frame.

The contents of the data scanning performed twice in each sub-frame and the timing of each data scanning are the same as those in the second embodiment shown in FIG. 12.

As described above, by converting red, green and blue image data into red, green, blue and white image data and then detecting the grayscale levels of the converted image data for each of the divided small regions within each sub-frame and adjusting the intensity of incident light on the liquid crystal panel 21 and the transmittance of the liquid crystal panel 21 based on the detection result, it is possible to further reduce the power consumed by the back-light 22 and achieve a further reduction in power consumption compared to the first and second embodiments. Note that the display characteristics are equivalent to those in the first and second embodiments and comparative example, and deterioration in the image quality is not seen.

Although the above-described embodiments are explained by illustrating, as an example, a field-sequential type liquid crystal display device using a transmission type liquid crystal element as a display element, the present invention is of course similarly applicable to other display devices using other display elements, for example, a digital micro-mirror device (DMD). In the case of using the DMD, the intensity of incident light on the display element and the reflectance of the display element are adjusted based on the detected grayscale levels of display data (image data). Besides, although the LED light source is illustrated, the light source to be used is not particularly limited to the LED light source, and it is possible to use any light source if it can switch, such as EL.

Furthermore, needless to say, the same effects can also be obtained with a color display device using color filters. The reason for this is that, in a color-filter type display device, when the liquid crystal panel is provided with color filters by supposing that the color of emitted lights of red, green and blue is white in the above-described first and second embodiments, it is possible to apply the present invention in the same manner.

Figure 16:
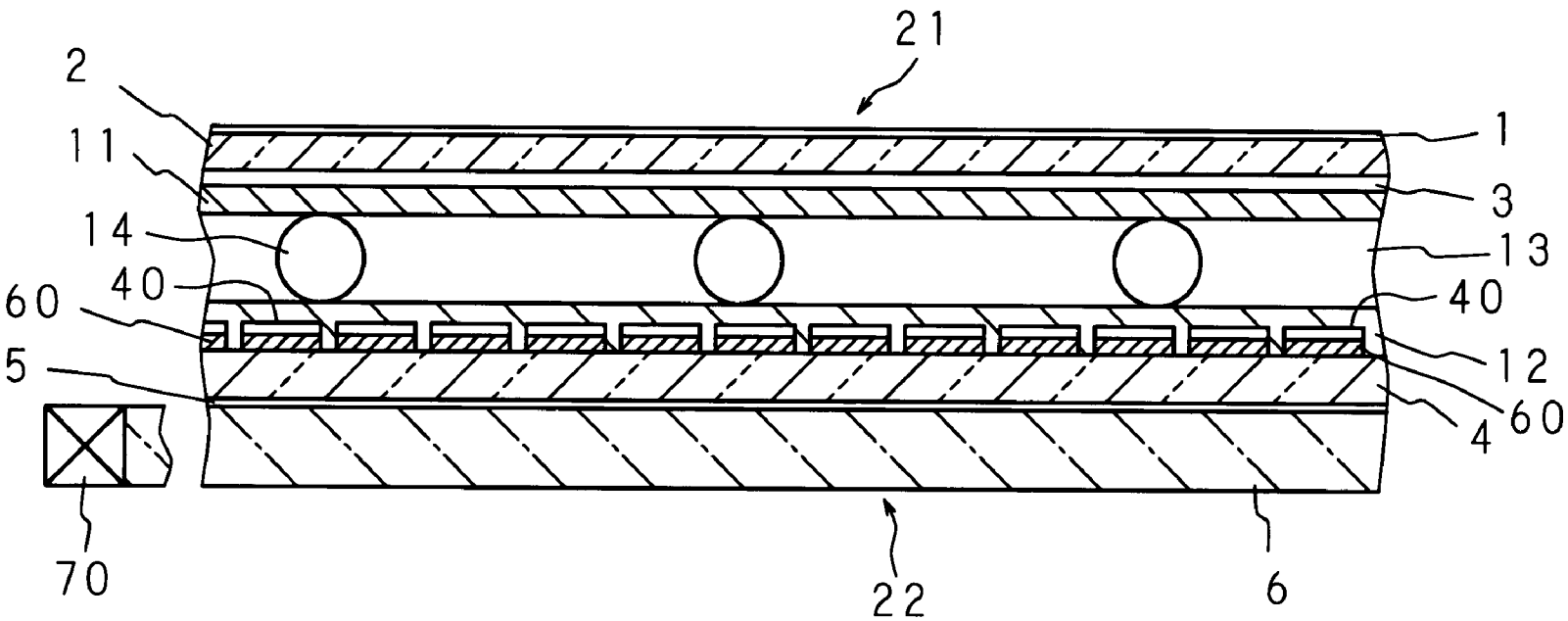
FIG. 16 is a schematic cross sectional view of a liquid crystal panel and a back-light in a color-filter type liquid crystal display device.

FIG. 16 is a schematic cross sectional view of the liquid crystal panel and the back-light of a liquid crystal display device using color-filters. In FIG. 16, the same parts as those in FIG. 6 are designated with the same numeric numbers, and the explanation thereof is omitted. Color filters 60 of the three primary colors (R, G, and B) are provided under the pixel electrodes 40. Alternatively, color filters may be provided between the glass substrate 2 and the common electrode 3 facing the pixel electrodes 40. Besides, the back-light 22 has a white light source 70 for emitting white light, and a light guiding/diffusing plate 6.

Such a color-filter type display device can achieve a reduction in power consumption without deteriorating the displayed image quality (brightness) by executing, in each frame, adjustments similar to the above-described adjustments of the intensity of incident light on the display element and the light control variable in the display element performed based on the grayscales levels of display data in each sub-frame according to the field-sequential method.

As described above, in the present invention, since the grayscale level of display data (image data) corresponding to light incident on the display element is detected and the intensity of incident light on the display element and the light control variable of the display element are adjusted based on the detection result, it is possible to adjust the intensity of incident light on the display element and the light control variable according to the display data. For example, for display data that does not require the brightest display, by reducing the intensity of light incident on the display element and adjusting the light control variable so as to increase the transmittance or reflectance of the incident light by the display element, it is possible to maintain the screen brightness equivalent to that obtained when the intensity of incident light and the light control variable are not adjusted, and achieve a further reduction in power consumption without causing deterioration in the displayed image quality, particularly a decrease in brightness.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A field-sequential type display device for performing a display by synchronizing successive switching of lights of only three colors, which consist of red, green and blue, to be incident on a display element with light control in said display element based on display data of each color corresponding to an image to be displayed, comprising:

a detecting unit for detecting a grayscale level of maximum brightness of the display data for each color, the grayscale level of the maximum brightness being variable for each of three sub-frames corresponding to the three colors throughout performing the display;

a light control variable adjusting unit for adjusting, independently for each color, an intensity of light incident on said display element and a light control variable in said display element, based on the respective grayscale level of each color detected in said detecting unit; and a transmittance adjusting unit for adjusting a transmittance of said display element, wherein said transmittance adjusting unit adjusts a transmittance of maximum grayscale level among grayscale levels in a sub-frame corresponding to a color detected by said detecting unit, to be larger than said transmittance of maximum grayscale level at the time when said intensity of light incident on said display element becomes maximum, said light control variable adjusting unit adjusts said intensity of light incident on said display element and said light control variable in said display element for each light of a color among said three colors, in accordance with said transmittance adjusted by said transmittance adjusting unit, and the display is performed with said adjusted light control variable.

2. The display device of claim 1, wherein when obtaining brightness of a grayscale level other than the grayscale level of maximum brightness, said light control variable adjusting unit adjusts the light control variable in said display element.

3. The display device of claim 1, wherein an intensity of light incident on said display element after adjusting the intensity of light and the light control variable by said adjusting unit is smaller than an intensity of light incident on said display element without performing the adjustments.

4. The display device of claim 1, wherein an incident region of light to be incident on said display element is divided, and the detection of a grayscale level by said detecting unit and the adjustments of the intensity of light and the light control variable by said adjusting unit are performed for each of the divided incident regions.

5. The display device of claim 1, wherein said display element is a liquid crystal display element.

6. The display device of claim 5, wherein a liquid crystal material used in said liquid crystal display element has spontaneous polarization.

7. The display device of claim 1, wherein said display element is a digital micro mirror device.

8. The display device of claim 1, wherein the lights of a plurality of colors to be incident on said display element are red light, green light, and blue light.

9. The display device of claim 1, wherein the lights of a plurality of colors to be incident on said display element are red light, green light, blue light, and white light.

10. The display device of claim 9, further comprising a converting unit for converting red, green and blue display data into red, green, blue and white display data, wherein said detecting unit detects grayscale levels of display data obtained by said converting unit.

11. A display method for performing a field-sequential type display by synchronizing successive switching of lights of only three colors, which consist of red, green and blue, to be incident on a display element with light control in said display element based on display data of each color corresponding to an image to be displayed, comprising:

detecting with a detecting unit, a grayscale level of maximum brightness of the display data for each color, the grayscale level of the maximum brightness being variable for each of three sub-frames corresponding to the three colors throughout performing the display;

adjusting, independently for each color, with a light control variable adjusting unit an intensity of light incident on said display element and a light control variable in said display element, based on the respective grayscale level of each color; and adjusting with a transmittance adjusting unit, a transmittance of said display element, wherein said transmittance adjusting unit adjusts a transmittance of maximum grayscale level among grayscale levels in a sub-frame corresponding to a color detected by said detecting unit, to be larger than said transmittance of maximum grayscale level at the time when said intensity of light incident on said display element becomes maximum, said light control variable adjusting unit adjusts said intensity of light incident on said display element and said light control variable in said display element for each light of a color among said three colors, in accordance with said transmittance adjusted by said transmittance adjusting unit, and the display is performed with said adjusted light control variable.

* * * * *